US007437844B1

(12) United States Patent
Kennedy

(10) Patent No.: US 7,437,844 B1
(45) Date of Patent: Oct. 21, 2008

(54) WIRE SUPPORT FRAME FOR CORRUGATED SIGN

(76) Inventor: Omar B. Kennedy, 100 E. Chestnut, Amite, LA (US) 70422

( * ) Notice: Subject to any disclaimer, the term of this patent is extended or adjusted under 35 U.S.C. 154(b) by 0 days.

(21) Appl. No.: 11/422,724

(22) Filed: Jun. 7, 2006

Related U.S. Application Data

(60) Provisional application No. 60/688,060, filed on Jun. 7, 2005.

(51) Int. Cl.
*G09F 15/00* (2006.01)

(52) U.S. Cl. ..... 40/607.03; 40/607.05; 248/156

(58) Field of Classification Search ..... 40/606.01, 40/607.03, 607.05; 248/156
See application file for complete search history.

(56) References Cited

U.S. PATENT DOCUMENTS 4,259,803 A * 4/1981 Sittler ..... 40/607.03
4,660,310 A * 4/1987 Farmer ..... 40/607.03
4,894,937 A * 1/1990 Davis ..... 40/607.03
5,042,183 A * 8/1991 Kennedy ..... 40/607.03
5,207,402 A * 5/1993 Berry-Tremmel et al. ... 248/156
5,307,580 A * 5/1994 Farmer ..... 40/607.03
5,595,010 A * 1/1997 Fuller et al. ..... 248/156
5,878,517 A * 3/1999 Gill ..... 40/607.03
6,547,204 B1 * 4/2003 Peck ..... 248/545
2005/0077441 A1 * 4/2005 Coverstone et al. ..... 248/156

* cited by examiner

*Primary Examiner*—Gary C Hoge
(74) *Attorney, Agent, or Firm*—Garvey, Smith, Nehrbass & North, L.L.C.; Charles C. Garvey, Jr.

(57) ABSTRACT

A wire frame for supporting a corrugated plastic sheet sign is disclosed. The improved wire frame has a transverse bar or bars that are of a greater diameter or thickness than the upper parts of the frame that connect with openings of the corrugated plastic sheet sign.

18 Claims, 3 Drawing Sheets

WIRE SUPPORT FRAME FOR CORRUGATED SIGN

CROSS-REFERENCE TO RELATED APPLICATIONS

Priority of U.S. Provisional Patent Application Ser. No. 60/688,060, filed Jun. 7, 2005, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to an improved wire frame support for holding a corrugated sign. More particularly, the present invention relates to an improved wire frame support of composite construction that provides an upper sign holding part, a lower portion with thicker or larger diameter stakes or legs, and a transverse bar that is reinforced for strength to receive the foot of a user during implantation of the legs into a soil mass. The upper end portion provides a pair of thinner or smaller diameter wire pins that are used to penetrate the corrugated sign.

2. General Background of the Invention

Several types of constructions have been used for holding common display signs which are used frequently in the real estate industry, for example in advertising the sale of homes. These signs can be held with a wooden support frame or holder having holes or slots therethrough for the attachment of screws and bolts. Wooden signs suffer in that they require a mallet or hammer in order to drive the support frame into the underlying soil mass. This can be time consuming, and sometimes impossible if the soil is dry and very hard. Further, it requires that the user carry around a heavy mallet or hammer in his or her possession in order to install the sign. The hammer can damage wooden part of the sign support frame, as they tend to crack after receiving repeated blows.

One particular type of sign has been patented which uses wire members of generally uniform construction (see U.S. Pat. No. 4,894,937). In the '937 patent, two longitudinally extending post members of the thin wire provide upper ends for supporting the sign and lower ends for driving into the underlying soil mass. A lower most transverse member is used for the placement of the user's foot thereon when driving the sign into the soil and an upper most transverse cross member defines a stop for limiting penetration of the longitudinal wires into the corrugated plastic sign.

The problem with wire signs of generally uniform thin wire material is that the signs are necessarily very flimsy because the wire is of a small diameter sized to fit the spaces or corrugations of the sign itself. Thus, the wire signs which are commercially available are generally very flimsy and prone to bending, breakage and the like. Further, because the wires are very light weight and flimsy they frequently bend when driving into very hard soil. In some instances, where the soil is very hard, not enough energy can be transferred through the foot of the user to the sign in order to drive it into the soil without breaking or bending the frame of the sign.

Another sign support that is of a wire construction is seen in U.S. Pat. No. 5,042,183 entitled "Composite Wire Stake Apparatus for Supporting Corrugated Signs".

BRIEF SUMMARY OF THE INVENTION

The apparatus of the present invention provides an improved wire frame for supporting a sign panel such as a corrugated plastic sign panel wherein a transverse rod functions as a step that enables a user to place his or her foot on the step and drive the frame legs into an underlying soil mass. In the preferred embodiment, the transverse bar is of a thicker, larger diameter material than that portion of the wire frame that is connected to the sign pane, e.g. placed into the vertical openings of the corrugated plastic sign.

The present invention relates to a unique concept for the construction of a sign panel holder for holding sign panels such as corrugated plastic sign panels. The method and apparatus of the present invention uses two pieces of wire that are preferably of different diameter. A thicker bottom wire is bent to form legs and a foot rest, a better holder due to thickness of the stepping point or step and added strength in the bends.

With the present invention, two wire parts can be used to construct a holder. One wire can be taller than the other. The bends at the top of each of the two parts gives extra strength while preserving simplicity of constructions.

The present invention can be used with smaller sign panels as well as larger sign panels: for example, four feet by eight feet (4'×8'). One of the strengths of the present invention is its ability to work with different sized sign panels. Indeed, different sized sign panels can be placed upon and supported by the same holder by varying the distance between the top end portions of the sign frame.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
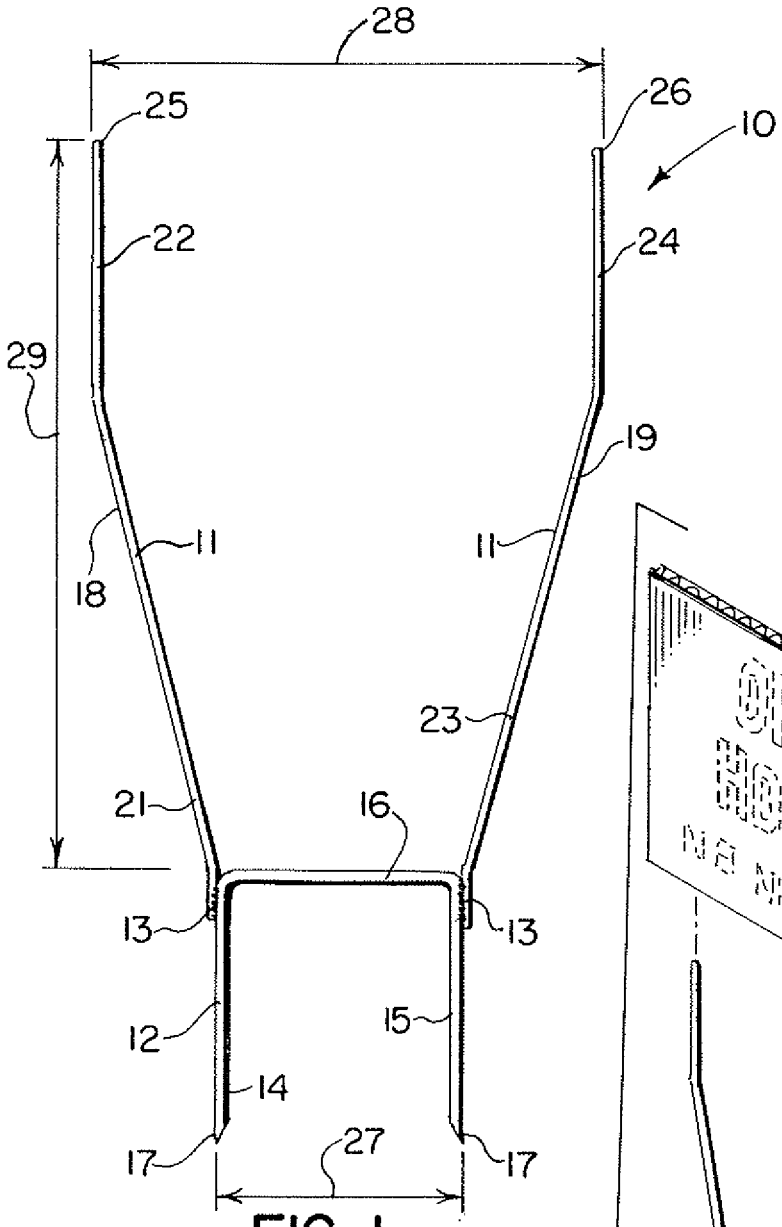
FIG. 1 is a front perspective view of the preferred embodiment of the apparatus of the present invention.
Figure 1A:
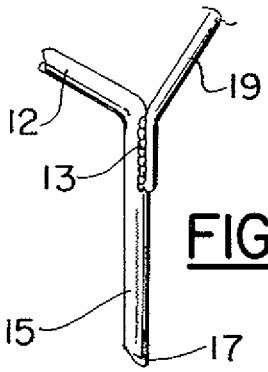
FIG. 1A is a fragmentary view of the preferred embodiment of the apparatus of the present invention.

FIGS. 1, 1A show a sign apparatus 10 having an upper section 11 and a lower section 12. The upper and lower sections 11, 12 can be connected together using a pair of spaced apart welds 13. The lower section 12 is U-shaped as shown in FIG. 1.

The U-shaped lower section 12 can be a unitary structure that includes spaced apart legs 14, 15 and transverse bar 16. In order to implant the sign in an underlying soil mass, a user steps upon the transverse bar 16 forcing the legs 14, 15 into the soil. Sculpted points 17 can be provided at the lower end portion of each leg 14, to enhance the cutting of the legs 14, 15 into the underlying soil.

A pair of spaced apart arms 18, 19 define upper section 11. Each of the arms 18, 19 includes a diagonally extending section and a vertically extending section. Arm 18 includes diagonally extending section 21 and vertically extending section 22. Similarly, arm 19 includes diagonally extending section 23 and vertically extending section 24. Each arm 18, 19 has an upper end. Arm 18 has upper end 25. Arm 19 has upper end 26.

Ends 25, 26 are inserted into vertical openings present in all commercially available corrugated plastic sheet signs (e.g. Coroplast®). Arrow 27 defines the width of the lower unshaped section 12 as preferably being between about 5 and 16 inches. Arrow 28 defines the spacing between the vertical sections 22, 24 of arms 18, 19, a dimension that is preferably between about 12 and 28 inches. Arrow 29 provides the overall length of each arm 18, 19, preferably a dimension of between about 4 and 32 inches. FIG. 1A shows more particularly, the welded connection 13 between an arm 19 and the lower u-shaped section 12, that weld being at the upper end portion of leg 15.

Figure 2:
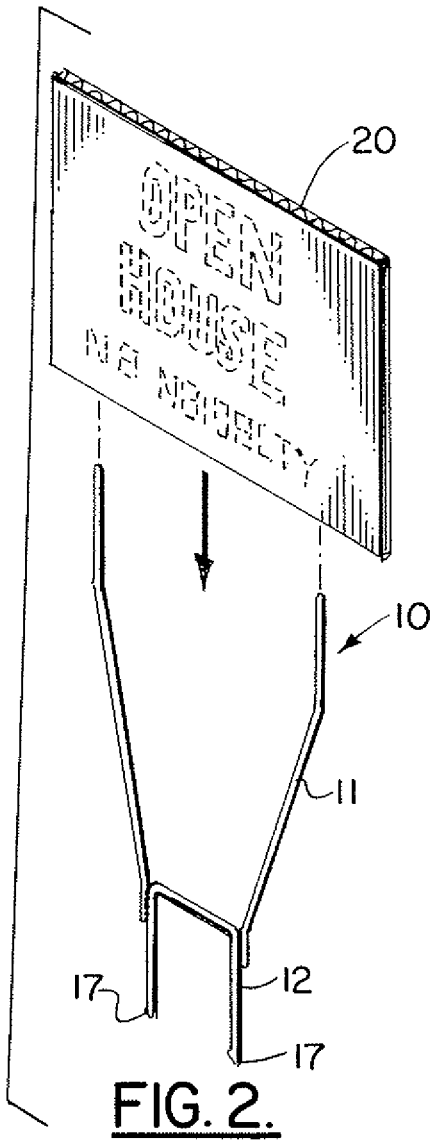
FIG. 2 is a perspective view of the preferred embodiment of the apparatus of the present invention.

In FIG. 2, corrugated sign 20 is shown being attached to frame 10 by extending the ends 25, 26 of the arms 18, 19 into the spaces between the corrugations of the commercially available sign 20, a plastic corrugated sheet material that is commonly used for making plastic signs (e.g. see www.coroplast.com). The vertical sections 22, 24 can be preferably embedded entirely in sign 20 once assembly is completed.

Figure 3:
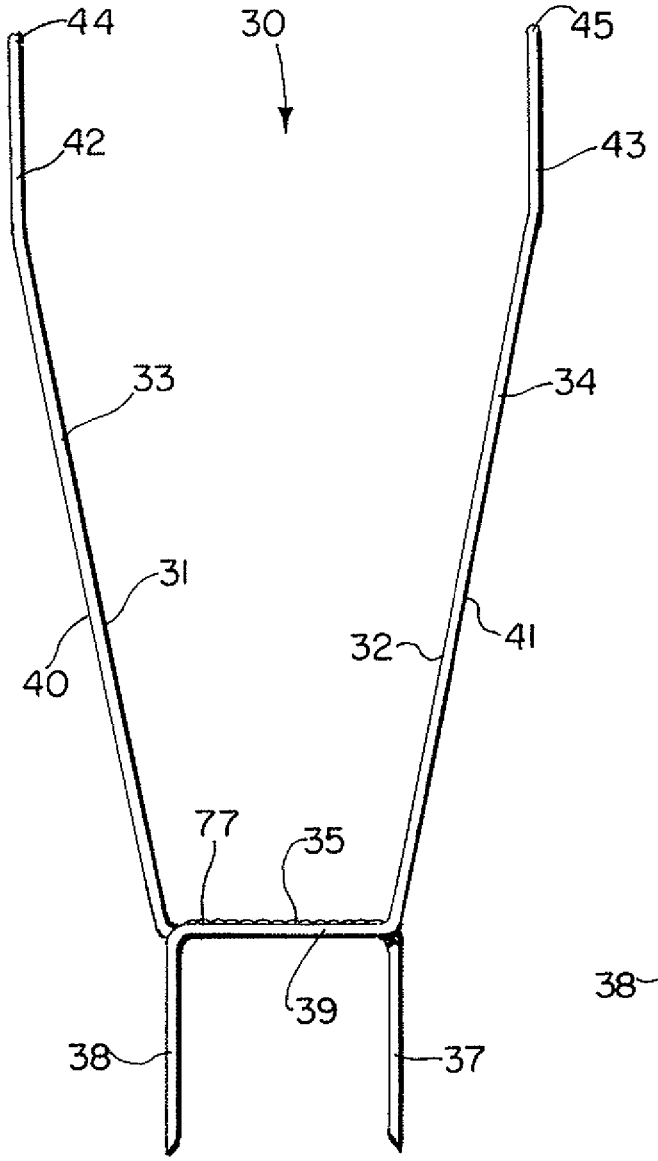
FIG. 3 is a front, elevational view of the corrugated sign to the wire support frame of a second embodiment of the apparatus of the present invention.
Figure 4:
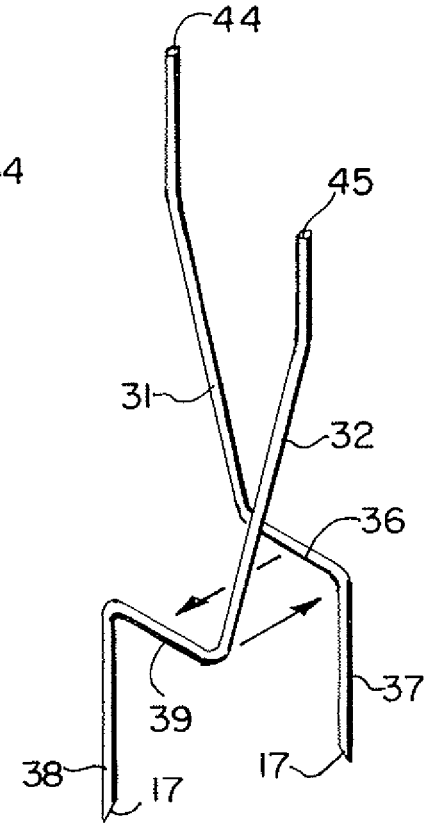
FIG. 4 is an exploded perspective view of the second embodiment of the apparatus of the present invention.
Figure 5:
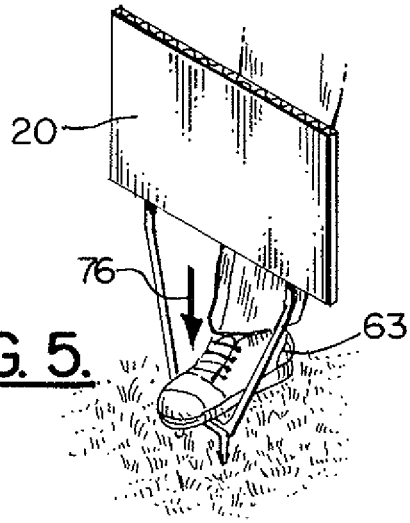
FIG. 5 is a perspective view of the second embodiment of the apparatus of the present invention.

FIGS. 3-5 show a second embodiment of the apparatus of the present invention, designated generally by the numeral 30. In the embodiment of FIGS. 3-4, sign support frame 30 includes a first section 31 and a second section 32. Each section 31, 32 provides an arm. The section 31 has arm 33. The section 32 has arm 34.

Each section 31, 32 has a transverse bar 36, 39 respectively. Weld 35 joins the sections 31, 32 together at transverse bars 36, 39. In FIG. 5, the foot of a user 63 is shown driving legs 37, 38 into the earth as indicated schematically by the numeral 76. Each section 31, 32 provides a leg. The section 31 has leg 37. The section 32 has leg 38. Each arm 33, 34 has a diagonally extending section. The arm 33 has diagonally extending section 40. The arm 34 has diagonally extending section 41.

Each arm 31, 32 has a vertically extending section that is mounted at the top of each of the diagonally extending sections 40, 41. The section 31 provides vertically extending section 42. The section 32 provides vertically extending section 43. Each of the vertically extending sections provides an end, the section 42 having end 44 and the section 43 having end 45. These ends 44, 45 are embedded in a corrugated sign 20 in a manner similar to that which they are inserted for the preferred embodiment of FIGS. 1-3.

Figure 7:
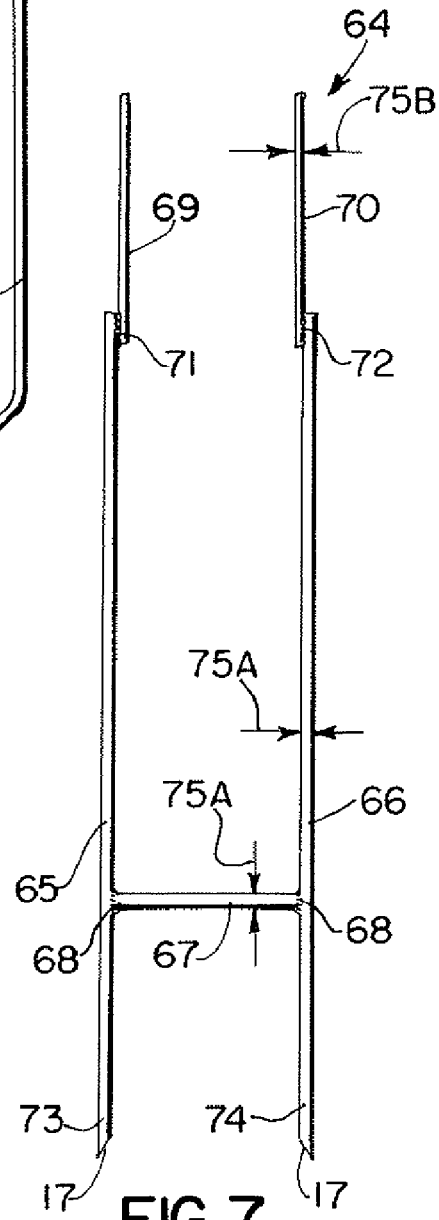
FIG. 7 is a front, elevation view of a fourth embodiment of the apparatus of the present invention.

A third embodiment of the apparatus of the present invention is designated generally by the numeral 46 in FIG. 7. Sign support frame 46 provides a left member 47 and a right member 48. Each of the members 47, 48 provides a leg 49, 54. The left member 47 is comprised of leg 49, diagonally extending section 50, vertically extending section 51, and smaller diameter rod 52 that is attached to the upper end portion of vertically extending section 51 with weld 61. Similarly, right member 48 includes leg 54, diagonally extending section 55, vertically extending section 56, and smaller diameter rod 57 that is attached to the upper end portion of vertically extending section 56 with weld 62.

Figure 6:
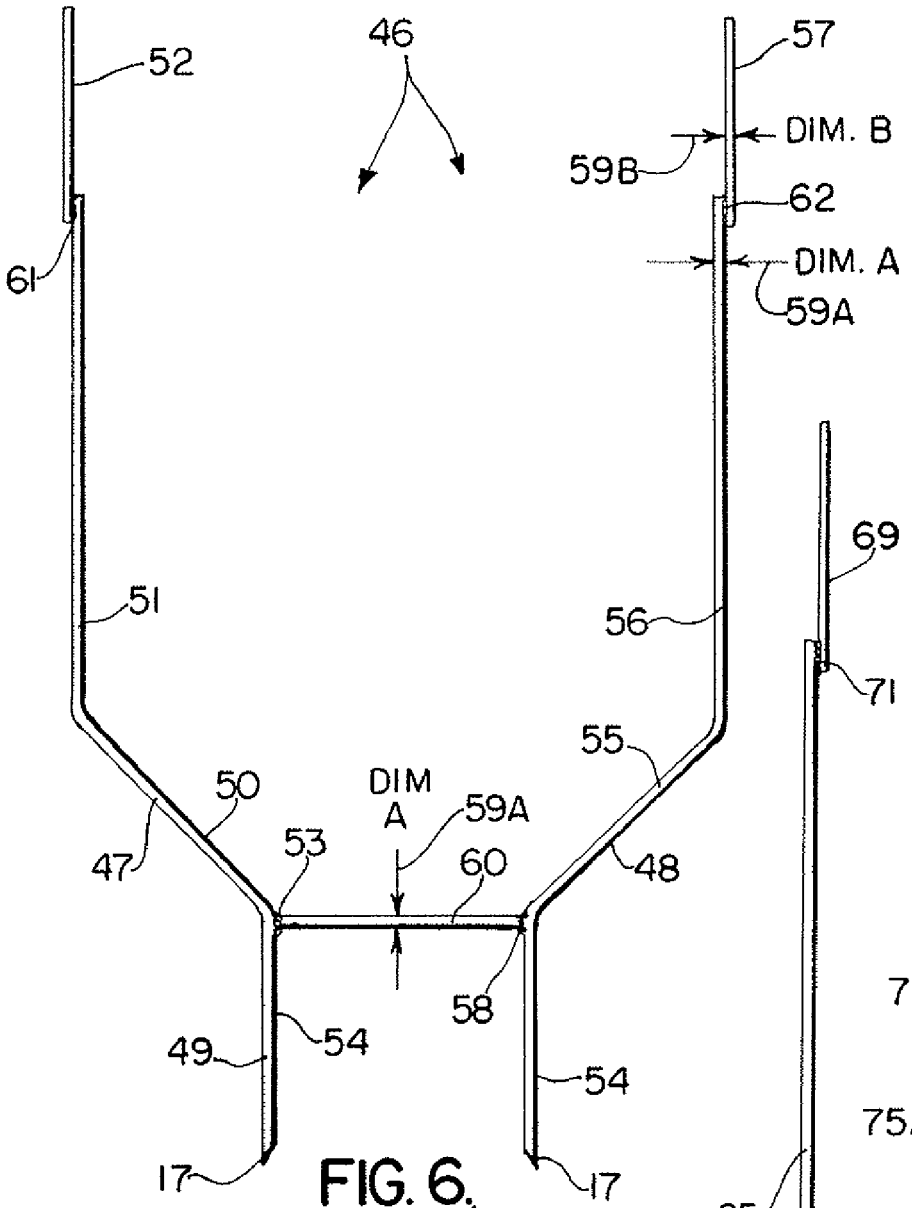
FIG. 6 is a front, elevation view of a third embodiment of the apparatus of the present invention.
Figure 8:
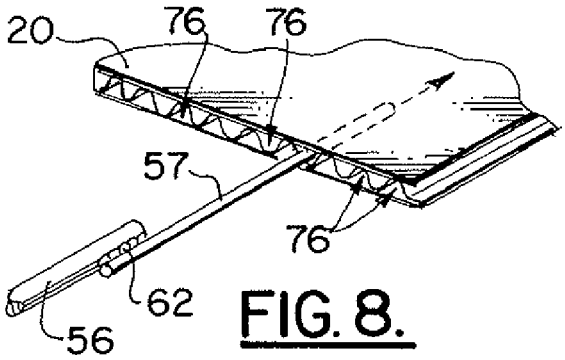
FIG. 8 is a fragmentary view of the third and fourth embodiments of the apparatus of the present invention.

A transverse bar 60 is attached to both left and right members 47, 48 using welds 53, 58 as shown in FIG. 6. For each of the left and right members 47, 48 a diameter 59A is provided that is much thicker than the diameter 59B for each of the smaller diameter rods 52, 57. The diameter 59B can be chosen so that smaller diameter rods 52, 57 fit into the openings present in commercially available corrugated plastic signs 20. The diameter 59A of members 47, 48, 60 can be much larger and heavier (e.g. twice as thick or even thicker).

In FIG. 7, a fourth embodiment of the apparatus of the present invention is indicated generally by the numeral 64. Sign support frame 64 includes left and right members 65, 66 each of which is preferably vertically positioned and a generally elongated linear member. A transverse bar 67 is attached to each of the members 65, 66 using a weld 68 as shown. At the upper end portion of each of the members 65, 66 there is provided a smaller diameter rod. Each of the smaller diameter rods 69, 70 is attached using a weld. Smaller diameter rod 69 is attached to left member 65 using weld 71. Similarly, smaller diameter rod 70 is attached to right member 66 using weld 72.

Each of the left and right members 65, 66 provides a leg section that can be driven into an underlying soil mass by a user 63. The user 63 simply places his or her foot on the transverse rod 67 and applies pressure downwardly in the direction of arrow 76 (as shown in FIG. 5). FIG. 5 is exemplary of installation of any of the embodiments of the present invention that is shown in FIGS. 1-8 of the drawings. In each of the embodiments, the transverse rod or rods 16, 60, 67 is of a diameter that is larger than that part of the sign support frame 10, 30, 46, 64 that is inserted into the openings 76 and the corrugated plastic sheet sign 20 (see FIG. 8).

In the embodiment of FIG. 3, a step 77 is defined by a pair of transverse bars 36, 39 that are welded together using weld 35 to thus provide an overall step 77 that is of a diameter or thickness that is greater than the thickness or diameter of that part of the frame 30 that is inserted into the sign 20 at openings 76.

In FIGS. 1-8, the arms are of a length (e.g. 8 or more inches) above the transverse bar or step that enables them to flex so that the frame 10, 30, 46, 64 can fit signs 20 of varying width.

For each of the embodiments shown, bends are used at the upper end portion to give extra strength while preserving the simplicity of construction. For example, in FIGS. 1, 1A-2 there are bends in between the sections 21, 22 and 23, 24 respectively. In FIG. 3, there is a bend in between the sections 40, 42. There is also a bend between the sections 41, 43. In FIG. 6, there is a bend in between the sections 50, 51 and in between the sections 55, 56.

The following is a list of parts and materials suitable for use in the present invention.

PARTS LIST

| Part Number | Description |
|---|---|
| 10 | sign support frame |
| 11 | upper section |
| 12 | lower section |
| 13 | weld |
| 14 | leg |

-continued

PARTS LIST

| Part Number | Description |
|---|---|
| 15 | leg |
| 16 | transverse bar |
| 17 | sculpted point |
| 18 | arm |
| 19 | arm |
| 20 | sign |
| 21 | diagonally extending section |
| 22 | vertically extending section |
| 23 | diagonally extending section |
| 24 | vertically extending section |
| 25 | end |
| 26 | end |
| 27 | arrow |
| 28 | arrow |
| 29 | arrow |
| 30 | sign support frame |
| 31 | first section |
| 32 | second section |
| 33 | arm |
| 34 | arm |
| 35 | weld |
| 36 | bar |
| 37 | leg |
| 38 | leg |
| 39 | transverse bar |
| 40 | diagonally extending section |
| 41 | diagonally extending section |
| 42 | vertically extending section |
| 43 | vertically extending section |
| 44 | end |
| 45 | end |
| 46 | sign support frame |
| 47 | left member |
| 48 | right member |
| 49 | leg |
| 50 | diagonally extending section |
| 51 | vertically extending section |
| 52 | smaller diameter rod |
| 53 | weld |
| 54 | leg |
| 55 | diagonally extending section |
| 56 | vertically extending section |
| 57 | smaller diameter rod |
| 58 | weld |
| 59 | height arrow |
| 59A | arrow |
| 59B | arrow |
| 60 | transverse bar |
| 61 | weld |
| 62 | weld |
| 63 | user |
| 64 | sign support frame |
| 65 | left member |
| 66 | right member |
| 67 | transverse bar |
| 68 | weld |
| 69 | smaller diameter rod |
| 70 | smaller diameter rod |
| 71 | weld |
| 72 | weld |
| 73 | leg section |
| 74 | leg section |
| 75A | arrow |
| 75B | arrow |
| 76 | opening |
| 77 | step |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A wire support frame for holding a corrugated sign in an upright position, comprising:

a) a u-shaped lower frame section that has a pair of spaced apart, longitudinally extending wire post members of a first diameter;

b) the u-shaped lower frame section providing a transverse cross beam connecting the pair of post members and defining a step for enabling a user to drive the posts into the underlying soil foundation;

c) a pair of upwardly extending diagonal wire pins directly connected respectively to the u-shaped section;

d) the wire posts having a diameter at least twice the diameter of the pins; and e) wherein the posts are of a length of between about ¼ and ½ the length of the pins.

2. The apparatus of claim 1 wherein the pins have vertical portions.

3. The apparatus of claim 1 wherein the pins are welded to the u-shaped section.

4. The apparatus of claim 1 wherein the pins are each welded to a post.

5. A wire support frame for holding a corrugated sign in an upright position, comprising:

a) a u-shaped lower frame section that has a pair of spaced apart, longitudinally extending wire post members of a first diameter;

b) the u-shaped lower frame section providing a transverse cross beam connecting the pair of post members and defining a step for enabling a user to drive the posts into the underlying soil foundation;

c) a pair of upwardly extending diagonal wire pins connected respectively to the u-shaped section;

d) the wire posts having a diameter at least twice the diameter of the pins; and e) wherein the pins are welded to the posts at a position next to the transverse cross beam.

6. The apparatus of claim 5 wherein the pins are wire pins having a diameter of between 0.10 and 0.350 inches.

7. The apparatus of claim 5 wherein the pins have vertical sections.

8. The apparatus of claim 5 wherein a welded connection joins the pins to the u-shaped section.

9. A wire support frame for holding a sign panel in an upright position, comprising:

a) a u-shaped lower frame section that has a pair of spaced apart, longitudinally extending wire post members of a first diameter;

b) the u-shaped lower frame section providing a transverse cross beam connecting the pair of post members and defining a step for enabling a user to drive the posts into the underlying soil foundation;

c) a pair of wire pins directly connected respectively to the u-shaped section and extending upwardly from the cross beam;

d) at least a part of the u-shaped lower frame having a thickened part with a transverse cross section that is greater than the transverse cross section of the pins; and e) wherein the posts are of a length of between about ¼ and ½ the length of the pins.

10. The apparatus of claim 9 wherein each pin is welded to a post.

11. A wire support frame for holding a sign panel in an upright position, comprising:

a) a u-shaped lower frame section that has a pair of spaced apart, longitudinally extending wire post members of a first diameter;

b) the u-shaped lower frame section providing a transverse cross beam connecting the pair of post members and defining a step for enabling a user to drive the posts into the underlying soil foundation;

c) a pair of wire pins connected respectively to the u-shaped section and extending upwardly from the cross beam;

d) at least a part of the u-shaped lower frame having a thickened part with a transverse cross section that is greater than the transverse cross section of the pins; and e) wherein the pins are welded to the posts at a position next to the transverse cross beam.

12. The apparatus of claim 11 wherein the pins are wire pins having a diameter of between 0.10 and 0.350 inches.

13. The apparatus of claim 12 wherein the pins have vertical portions.

14. The apparatus of claim 12 wherein the pins are welded to the u-shaped section.

15. A wire support frame for holding a sign panel in an upright position, comprising:

a) a u-shaped lower frame section that has a pair of spaced apart, longitudinally extending wire post members of a first diameter;

b) the u-shaped lower frame section providing a transverse cross beam connecting the pair of post members and defining a step for enabling a user to drive the posts into the underlying soil foundation;

c) an upper frame section that extends upwardly from the step, the upper frame section including a pair of spaced apart pins that are directly connected to the step and that include sign panel holding portions of a transverse cross section that is smaller than the transverse cross section of the step;

d) one or more welded connections that join the portions of smaller transverse cross section to the portions of larger transverse cross section; and e) wherein the posts are of a length of between about ¼ and ½ the length of the pins.

16. The apparatus of claim 15 wherein the pins are each welded to a post.

17. A wire support frame for holding a sign panel in an upright position, comprising:

a) a u-shaped lower frame section that has a pair of spaced apart, longitudinally extending wire post members of a first diameter;

b) the u-shaped lower frame section providing a transverse cross beam connecting the pair of post members and defining a step for enabling a user to drive the posts into the underlying soil foundation;

c) an upper frame section that extends upwardly from the step, the upper frame section including a pair of spaced apart pins that include sign panel holding portions of a transverse cross section that is smaller than the transverse cross section of the step;

d) one or more welded connections that join the portions of smaller transverse cross section to the portions of larger transverse cross section; and e) wherein the pins are welded to the posts at a position next to the transverse cross beam.

18. The apparatus of claim 17 wherein the pins are wire pins having a diameter of between 0.10 and 0.350 inches.

* * * * *